United States Patent [19]

Stoody

[11] 4,383,399

[45] May 17, 1983

[54] PRESSURIZATION METHOD FOR AEROSOL DISPENSER

[76] Inventor: William R. Stoody, 8659 Summerdale Rd., San Diego, Calif. 92126

[21] Appl. No.: 254,927

[22] Filed: Apr. 16, 1981

Related U.S. Application Data

[63] Continuation-in-part of Ser. No. 41,867, May 23, 1979, Pat. No. 4,265,373.

[51] Int. Cl.[3] ..... B65B 31/00

[52] U.S. Cl. ..... 53/470; 141/3

[58] Field of Search ..... 239/323; 222/92, 94, 222/95, 386.5, 402.18; 141/1, 2, 3, 20, 10, 114, 141/313–317; 53/470, 474

[56] References Cited

U.S. PATENT DOCUMENTS

| | | | |
|---|---|---|---|
| 3,178,075 | 4/1965 | Riedl et al. | 222/386.5 |
| 3,217,931 | 11/1965 | Farrar et al. | 222/94 |
| 3,300,102 | 1/1967 | Budzich | 222/386.5 |
| 3,317,090 | 5/1967 | Meshberg | 222/386.5 |
| 3,490,651 | 1/1970 | Abplanalp | 222/94 |
| 3,705,667 | 12/1972 | Blaine et al. | 222/386.5 |
| 3,894,659 | 7/1975 | Focht | 222/94 |
| 3,992,003 | 11/1976 | Visceglia et al. | 222/94 |

*Primary Examiner*—Houston S. Bell, Jr.

[57] ABSTRACT

The method of filling and pressurizing an aerosol type container having a fill-opening which comprises introducing a dispensable fluid product into the container for storage therein, projecting an expansible sac having an open end into the container through its fill-opening, overlapping the open end of the sac upon the fill-opening, introducing a pressurized fluid into the sac for storage therein, successively disposing a valve mechanism into the container to overlie the sac open end and closing the sac and fill-opening for sealing the dispensable fluid within the container and for sealing the pressurized fluid within the sac and closing the container; and extending a communicating means from the valve mechanism through the sac establishing communication between the valve mechanism and the fluid product for isolated passage of the fluid product therethrough.

4 Claims, 4 Drawing Figures

PRESSURIZATION METHOD FOR AEROSOL DISPENSER

RELATED APPLICATIONS

The present application is a continuation in part of co-pending patent application Ser. No. 041,867 filed May 23, 1979, now U.S. Pat. No. 4,265,373. Applicant's related co-pending applications are Ser. No. 860,354 filed Dec. 14, 1977, now U.S. Pat. No. 4,159,789 dated July 3, 1979; Ser. No. 887,580 filed Mar. 17, 1978, now U.S. Pat. No. 4,189,069 dated Feb. 9, 1980; and Ser. No. 928,056 filed July 16, 1978, now U.S. Pat. No. 4,211,344.

BACKGROUND OF THE INVENTION

The present invention represents an economical and superior self-contained, portable aerosol dispenser that is in-tune with energy and pollution attitudes of the present time. Smaller amounts of energy intensive, smog causing hydrocarbon propellants, can be used to accomplish the same spray results of present day aerosols without sacs. Problems associated with aerosols having a collapsible sac have been eliminated.

Heretofore, aerosol type dispensers included a rigid outer container, a valve mechanism, a dispensable fluid product in containment within a collapsible sac, liner, bag, etc., under pressure of propellant gas confined outside the said sac. Such dispensers have had limited application. All have at least one of the following disadvantages:

1. Sacs sized for efficient use, require preassembly within the container by a container manufacturer. Preassembly requires costly special handling, and is not generally accepted.
2. Sacs are of a reduced and inefficient size, for insertability through a universal size one inch annular opening in the container. Usually such sacs require prefilling with a fluid product, a difficult and expensive process.
3. Collapsible sacs are prone to paneling, a condition which entraps a substantial portion of the product.
4. Accessibility of propellant vapors for atomization or valve cleaning is prevented.
5. Filling with a fluid product must be accomplished through a valve mechanism, a slow costly prodecure.
6. Introduction of the propellant must be accomplished in an unorthodox manner, requiring special equipment.

PRIOR ART

Other dispensers in the art, having a sac, are shown in the following United States Patents, also, the above listed itemized disadvantages, as applicable, are indicated in parentheses:

| U.S. PAT. NO. | DATE | INVENTOR | DISADVANTAGE |
|---|---|---|---|
| 3,549,058 | Dec. 22, 1970 | E. J. Boik | (1,4,6) |
| 2,816,691 | Dec. 17, 1957 | L. T. Ward | (2,3,5) |
| 3,731,854 | May 8, 1973 | D. E. Casey | (2,4,6) |
| 3,169,670 | Feb. 16, 1965 | P. Hrebernak, L. Zuckerman | (2,3,4,6) |
| 3,982,668 | Sept. 28, 1976 | P. R. Riccio | (2,3,5) |
| 3,610,481 | Oct. 5, 1971 | L. L. Marraffino | (2,3,5) |
| 3,520,450 | July 14, 1970 | S. B. Prussin, et al | (2,3,5) |
| 3,525,456 | Aug. 25, 1970 | S. Prussin, et al | (2,3,5) |
| 3,583,606 | June 8, 1971 | R. F. Ewald | (2,3,5) |

-continued

| U.S. PAT. NO. | DATE | INVENTOR | DISADVANTAGE |
|---|---|---|---|
| 4,032,064 | June 28, 1977 | E. D. Giggard | (1,4,6) |
| 3,477,195 | Nov. 11, 1969 | C. D. Chambers | (1,2,4,6) |

The expander liner disclosed in the L. T. Ward patent was merely to prevent an adverse reaction of intermixed product and propellant with the metal container. The sac has no effect on the dispensing function.

SUMMARY OF THE INVENTION

It is the object of the present invention to provide an aerosol type dispenser, of conventional dimensions and structure, wherein, propellant gas is confined within an expansible sac and is isolated from a dispensable fluid product.

It is another object to provide a conveyance for the product, to a dispensing valve mechanism.

Another object is to provide a sac contained dispenser within which the product has been disposed prior to the addition of the sac.

Another object is to provide a sac contained dispenser that can be pressurized in the same manner as dispensers without sacs.

It is a further object to provide a sac contained dispenser, from which a controlled amount of propellant gas vapor may be dispensed separately or co-dispensed with the fluid product.

It is a further object to provide a method of filling and pressurizing an aerosol type container.

These and other objects and advantages will be seen from the following specification and claims in conjunction with the appended drawings. The drawings are for illustration purposes only.

THE DRAWING

DETAILED DESCRIPTION OF THE INVENTION

Specific terminology resorted to in describing the illustrative embodiments of the invention is not intended to be limiting. It is understood that this is for clarity and includes all technical equivalents which function is a similar manner to accomplish a similar purpose or results.

Figure 1:
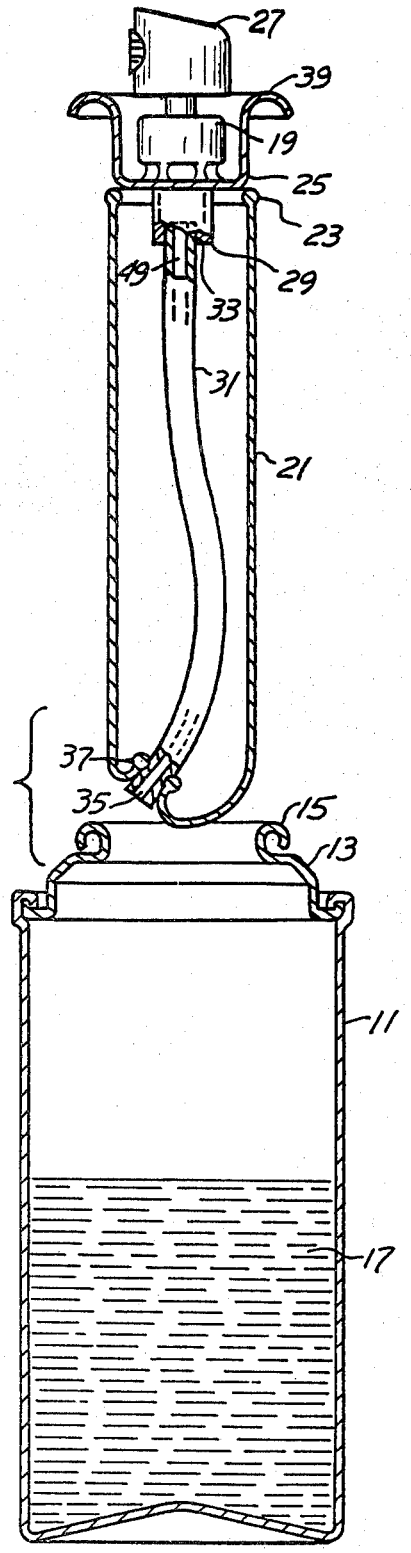
FIG. 1, is an exploded view of the present dispenser and sac.
Figure 2:
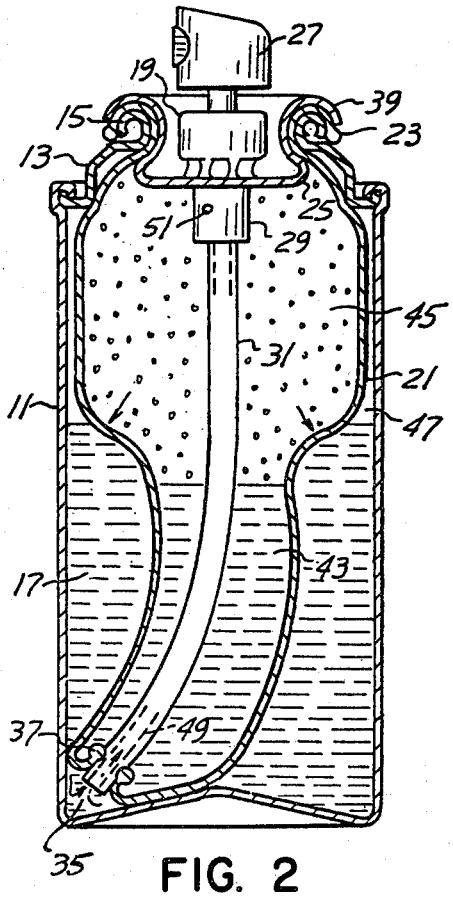
FIG. 2, is a vertical section of the assembled dispenser.

FIGS. 1 and 2, disposed within the closed bottom container 11, which includes a top closure 13 having an outwardly curled annular fill opening 15, is a predetermined amount of a dispensable fluid product 17. Partially inserted into container 11 is a valve mechanism 19 and expandable sac 21 which is capable of expanding to the internal extremities of container 11 and has an annular open end 23.

Valve mechanism 19 includes a disk-like valve retaining cup 25, an outwardly protruding movable dispensing nozzle 27, that is in communicating engagement with valve shut-off components, not shown, that are housed within a valve body 29. Depending from aperture 33 of the valve body 29 is a dip tube or communicating means 31. An open end 35 of dip tube 31 is in secure engagement with an aperture 37 located in a lower extremity of sac 21.

Figure 3:
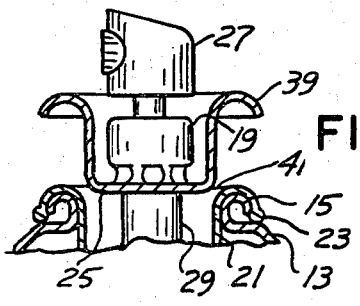
FIG. 3, is a fragmentary exploded view of the dispenser of FIG. 2.

Prior to pressurization, FIG. 3, annular opening 23 of sac 21 overlaps and retainingly engages curled annular fill opening 15 of top closure 13 in a manner that will allow entry of pressurization fluid to the interior of said sac only. A matingly formed peripheral rim 39 of valve retaining cup 25 is positioned above the resulting annular access opening 41 of sac 21.

Pressurization can be accomplished by an industry preferred method known as, "over the cap filling", using non-sac aerosol pressurizing and closure equipment. A propellant, of any suitable pressurizing material is employed, preferably a liquified pressure exerting gas that vaporizes at reduced pressures to a gaseous state and thereby maintains a predetermined pressure at a given temperature. One such propellant is a hydrocarbon. Other pressurizing agents, such as compressed air, are suitable for use where a diminishing pressure, such as caused by dispensing a product, is not a detriment.

FIGS. 2 and 3, a liquified propellant 43 is forced into sac 21, passing under retaining cup rim 39 and through sac access opening 41. Valve mechanism 19 and sac 21 are secured in sealing engagement within top closure 13 immediately after a specified quantity of propellant has entered sac 21. This normally occurs in a single pressurizing and closure operation. Propellant 43 in a liquid state settles in the lower portion of sac 21, and propellant vapor 45 forms in the upper portion of sac 21.

FIG. 2, pressure exerted by propellant 43 and vapor 45 inflate sac 21 within container 11 forcing sac 21 to occupy the space above product 17. The pressure also causes sac 21 to exert an expulsion force onto product 17.

Entrapped air 47 intermediate container 11 and outer surfaces of sac 21 can be ignored since the air is also under equal pressure resulting from the forced expansion of sac 21. Air 47 thereby exerts equal pressure onto product 17. However should a reason exist, small apertures, not shown, can be placed in discreet locations of top closure 13. Air 47 could then escape. Expansion of sac 21 provides a sealing means within container 11 preventing product 17 from escaping.

Dispensing occurs when valve mechanism 19 is manually actuated. This generally occurs from depressing nozzle 27. Nozzle 27 subsequently forces valve shut-off components, not shown, housed in valve body 29 into their respective open positions. Product 17 under pressure is forcefully conveyed into valve mechanism 19 and ultimately out of nozzle 27 in an enclosed passageway 49 within sac 21 by virtue of dip tube 31. As product 17 is expelled, space initially occupied by product 17 is correspondingly consumed by sac 21.

In the present invention valve mechanism 19 is only defined to the extent necessary. Specific functional characteristics have been omitted since a variety of conventional valve mechanisms are applicable. The appropriate valve mechanism 19, choice depending on the dispensing application, will permit co-dispensing of product 17 with vapor 45 to achieve an atomized spray; separate dispensing whereas, propellant vapor 45 is dispensed only to remove product residue from within valve mechanism 19; dispensing product 17 only to prevent loss of propellant 43. A variety of dispensing applications are possible because vapor 45 is confined with valve body 29. Therefore vapor 45 is available to the valve mechanism as through orifice 51, FIG. 2, as applicable. Examples of valve mechanisms that may be employed with shut-off components are shown in one or more of the above listed prior art patents. No claim is made to a specific valve mechanism.

MODIFICATION

Figure 4:
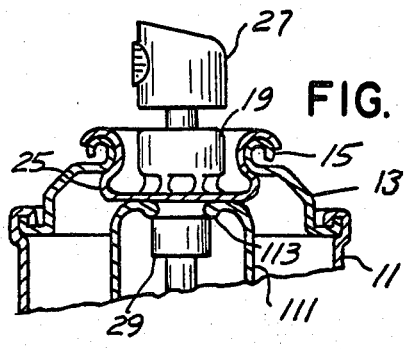
FIG. 4, is a similar view of a modification.

A modification, FIG. 4, differs from the above in that annular open end 113 of sac 111 is in secure sealing engagement with valve body 29. Valve mechanism 19 is sealingly secured and nested in annular curled fill opening 15 in top closure 13 prior to pressurization. Propellant 43 is forced into sac 111 by back-filling through valve mechanism 19. Such filling is common to aerosol packagers however, it is preferred only over unorthodox methods.

METHOD OF FILLING AND PRESSURIZING AEROSOL TYPE CONTAINERS

The present method is for a container having a fill-opening and includes:

1. Introducing a dispensable fluid product 17 into container 11 for storage therein;
2. Projecting an expansable sac 21 having an open end 23 into the container through its fill-opening 15;
3. Overlapping the open end 23 with the sac upon the fill-opening 15;
4. Introducing a pressurized fluid 43–45 into the sac for storage therein as in FIG. 3;
5. Successively disposing a valve mechanism 19–29 into the container, FIG. 2 to overlie the sac open end 23 enclosing the sac and fill-opening for sealing the dispensable fluid 17 within the container 11 and for sealing the pressurized fluid 43–45 within the sac 21 and closing the container;
6. Extending a communicating means, namely tube 31 from the valve mechanism 29 through the sac, FIG. 2 as at 37 establishing communication between the valve mechanism and the fluid product at 35 for isolated passage of fluid product therethrough.

The container 11 for introducing the fluid product is empty. The valve mechanism 19–29, sac 21 and the communicating means 31 are located within container 11. The intermediate step before pressurizing the sac includes elevating the valve mechanism 19–29, FIG. 3 spacing it above the sac opening 23 during the introduction of the pressurized fluid 43–45 to the interior of the sac. Valve means 19–29 is successively and immediately projected down into the sac opening 23, FIG. 2 closing container 11 as well as the sac 21.

The foregoing step therefore, includes intromission of the pressurizing fluid into the expansable sac just prior to closure of the container.

The positioning of the valve mechanism for effecting secure closure engagement with the container fill opening 15 includes sealingly securing the sac upper end at 23 between the container fill-opening 15 and the valve mechanism including the member 39 connected thereto.

A further step includes from the alternative the capability of the valve mechanism 19–29 additionally communicating the pressurized fluid 43–45 upon the interior sac as through the aperture 51 shown in FIG. 2.

By this method as shown in FIGS. 3 and 2 overlying opening 23 of the sac is adapted to allow pressurizing fluid to enter the interior of the sac only, as shown in FIG. 3.

Having described my invention, reference should now be had to the following claims:

I claim:

1. The method of filling and pressurizing an aerosol dispenser having a container for product fluid containment, and having for pressurizing fluid containment, an expansible sac having an open end and an associated communicating means depending from a valve mechanism for isolated passage of product fluid, which comprises;

placing product fluid within said container through a top fill-opening of said container;

positioning said sac thereinto, and engaging the open end of said sac upon said fill-opening;

thereafter, passing pressurizing fluid into said sac through the engaged open end of said sac;

and successively projecting and securing said valve mechanism into the engaged open end of said sac, effecting sealing closure of said container and said sac.

2. In the method of claim 1, the engaged open end of said sac being adapted to allow said pressurizing fluid to enter the interior of said sac only.

3. In the method of claim 1, the intermediate step of elevating the valve mechanism, spacing it above the open end of said sac during the introduction of pressurizing fluid into the interior of said sac.

4. In the method of claim 1, said valve mechanism additionally being in communication with the interior of said sac.

* * * * *